US005377468A

United States Patent [19]

Repasky

[11] Patent Number: 5,377,468

[45] Date of Patent: Jan. 3, 1995

[54] AERODYNAMICALLY STABLE ROOF PAVER SYSTEM AND BALLAST BLOCK THEREFOR

[75] Inventor: John Repasky, Hanover, Pa.

[73] Assignee: Hanover Architectural Products, Inc., Hanover, Pa.

[21] Appl. No.: 53,917

[22] Filed: Apr. 27, 1993

[51] Int. Cl.[6] ..... E04B 5/00; E04B 7/00; E04C 1/39; E04D 3/24

[52] U.S. Cl. ..... 52/302.4; 52/505; 52/408; 52/604; 52/605; 52/606

[58] Field of Search ..... 52/302.4, 302.1, 603-609, 52/747, 505, 408

[56] References Cited

U.S. PATENT DOCUMENTS

| | | | |
|---|---|---|---|
| 1,455,657 | 5/1923 | Pontello | 52/606 X |
| 3,077,703 | 2/1963 | Bergstrom | 52/408 X |
| 3,079,730 | 3/1963 | Donegan | 52/408 X |
| 3,387,420 | 6/1968 | Long | 52/302.3 |
| 3,619,961 | 11/1971 | Sterrett | 52/302.1 |
| 3,969,851 | 7/1976 | Whitacre | 52/747 X |
| 4,274,238 | 6/1981 | O'Riordian | 52/408 |
| 4,506,483 | 3/1985 | Phalen, Jr. . | |
| 4,535,579 | 8/1985 | Burgoyne et al. . | |
| 4,574,536 | 3/1986 | Bamber et al. . | |
| 4,655,018 | 4/1987 | Pardo . | |
| 4,977,730 | 12/1990 | Pardo | 52/605 X |

FOREIGN PATENT DOCUMENTS

| | | | |
|---|---|---|---|
| 0024826 | 7/1922 | France | 52/607 |
| 1552242 | 1/1969 | France | 52/608 |
| 1558871 | 2/1969 | France | 52/608 |
| 0287359 | 11/1989 | Japan | 52/605 |
| 0143749 | 6/1920 | United Kingdom | 52/607 |

*Primary Examiner*—Carl D. Friedman
*Assistant Examiner*—Robert J. Canfield
*Attorney, Agent, or Firm*—Howson and Howson

[57] ABSTRACT

A protected-membrane roof paving system and method of constructing same. Rectangular ballast blocks are laid in rows and interlocked by tongue and groove edge faces. The adjacent blocks in each row form labyrinthine channels between their edge faces for drainage and equalization of air pressure above and below the blocks.

19 Claims, 5 Drawing Sheets

AERODYNAMICALLY STABLE ROOF PAVER SYSTEM AND BALLAST BLOCK THEREFOR

BACKGROUND OF THE INVENTION

The present invention relates generally to roof paving systems, and more particularly it relates to an improved protected-membrane roof and deck paver system which is aerodynamically stable and to a ballast block for use in such system.

Recent developments in roof paver technology have resulted in the introduction of single-ply protected-membrane roof systems which are especially suitable for low-sloped roofs and decks. They usually include a single-ply water-impermeable membrane, with or without thermal insulation layers, held in place and protected from the elements by ballast systems of various types and configurations. Basic systems include loose-laid well-rounded stones such as river gravel, standard paving blocks, composite tongue-and-groove board, and lightweight interlocking ballast blocks. In general, ballast systems are often the preferred system of choice in areas where exposure to high wind conditions may be anticipated because they are capable of withstanding greater wind velocities than conventional built-up roofing systems. Studies have also shown that ballast systems which utilize interlocking blocks perform even better under adverse (strong) wind conditions than non-interlocking ballast systems.

The interlocking blocks are usually extruded or precast concrete of flat rectangular shape laid over a roof membrane in a contiguous grid pattern. However, even this construction does not assure dislodgement of the ballast blocks under certain weather conditions. High velocity winds, such as of hurricane-force, passing over irregular or critical roof locations may induce an aerodynamic pressure differential across the blocks to lift them out of place. Instead of simply making ballast blocks heavier and the roof supports stronger, various designs have evolved for resisting the lifting force, such as the aforementioned lightweight ballast blocks secured to each other by interlocking edges. However, despite these design efforts, the net upward aerodynamic loading acting on the ballast blocks may lift them into the airstream like flying missiles and endanger people and other structures in the vicinity as well as expose the underlying roof membrane and substructure to damage.

SUMMARY OF THE INVENTION

Accordingly, it is an object of the present invention to provide an improved roof paver system having ballast blocks designed and laid to resist lifting out of place under unusual wind conditions.

Another object is to provide a roof ballast block which is suitable for interlocking with adjacent blocks of like construction in a manner that permits air to flow freely between the topsides and bottomsides of adjacent blocks upon exposure to aerodynamically-induced reductions in air pressure above the blocks.

Still another object is to provide a ballast block which forms a labyrinthine channel with an adjacent ballast block for both equalizing air pressure above and below the laid blocks and permitting fluids to pass between adjacent blocks without direct exposure of underlying roofing materials to the elements.

A further object of the invention is to provide a unique arrangement of ballast blocks in a roof paver construction which resists failure due to aerodynamic lift induced by unusual wind conditions and which resists deterioration due to freeze-thaw cycles.

A still further object is to provide a prefabricated ballast block which is lightweight, resistant to breakable in handling, can be manufactured at low cost, and which is relatively easy to install.

Another object of the invention is to provide a roof paver system in which damaged blocks can be easily replaced with minimal adverse affect on the integrity of the roof system.

Briefly, these and other objects of the invention are accomplished by providing ballast blocks which interlock in a staggered pattern over a roof membrane. Each block is defined by generally parallel flat top and bottom sides and peripheral edge faces. Two of the edge faces opposite each other have, respectively, a projecting tongue and a complementary groove for interlocking with corresponding tongues and grooves of edge faces of adjacent blocks. One of the remaining pair of edge faces has a flat surface perpendicular to the top and bottom sides of the block, and its other opposite edge face has a longitudinal groove and upper and lower recesses opening into the groove from the topside and bottomside at spaced intervals. In a plane perpendicular to the top and bottom sides on the block, the recesses on one side of the groove are offset from the recesses on the other side to form with the groove a series of labyrinthine channels between the top and bottom sides of the block when abutted with the flat edge of an adjacent block.

Ribs project in spaced parallel relation from the bottom side of the block to provide feet for defining a chamber between the underside of the block and the roof membrane. The channels enable water to drain between the block edges to a gutter, downspout or similar discharge means communicating with the chamber beneath the blocks in a manner that also prevents direct exposure of the roof membrane to the elements. The channels provide drainage while equalizing across the top and bottom sides of the blocks any differential air pressure caused by aerodynamic factors.

BRIEF DESCRIPTION OF THE DRAWINGS

For a better understanding of these and other objects and aspects of the invention, reference may be made to the following detailed description taken in conjunction with the accompanying drawings, wherein.

DESCRIPTION OF THE PREFERRED EMBODIMENT

Figure 1:
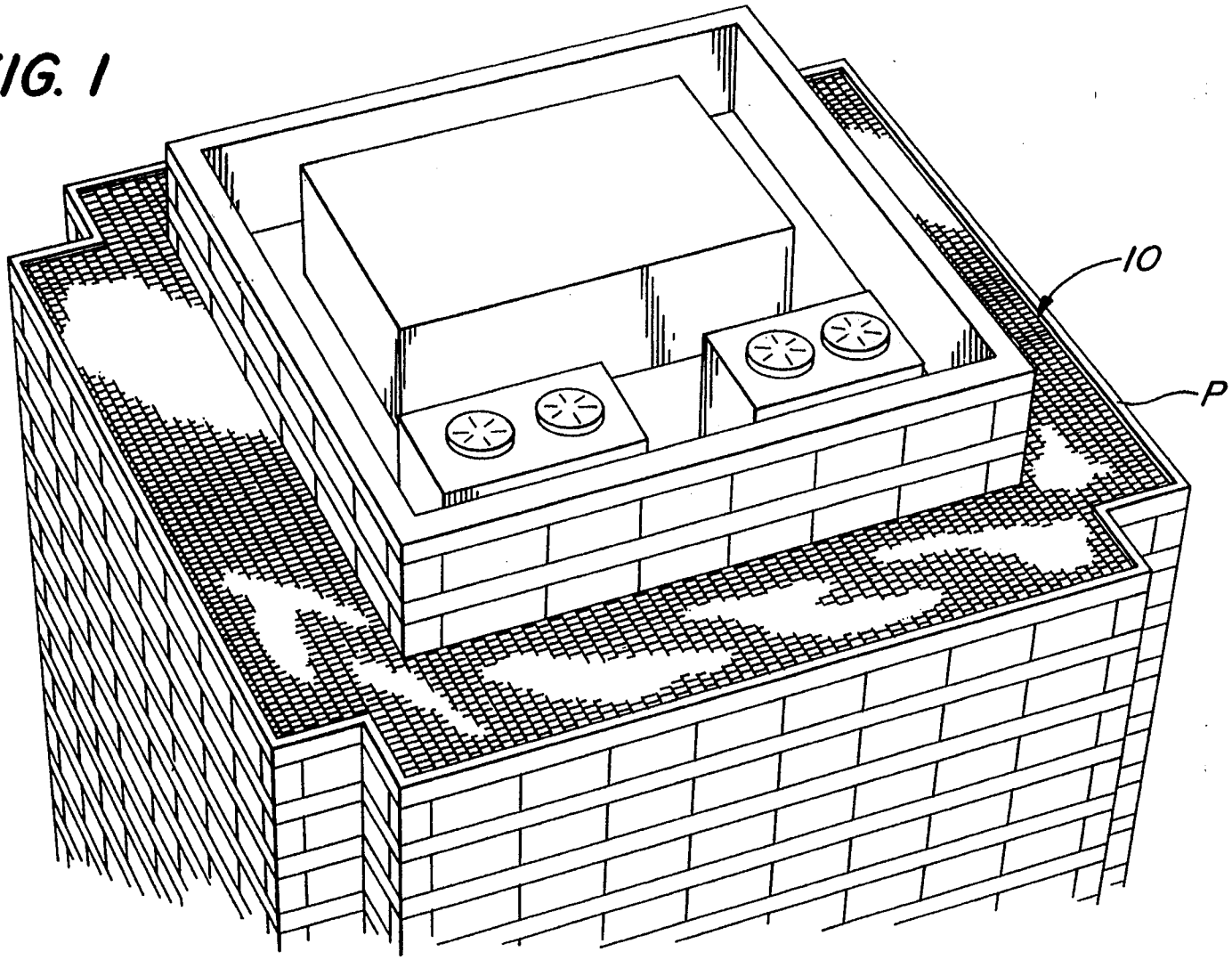
FIG. 1 represents an aerial view of a building with a roof paver system with interlocking ballast blocks according to the invention.

Referring now to the drawings wherein like referenced characters denote like or corresponding parts throughout the several views, FIG. 1 illustrates a protected-membrane paver system 10 embodying the present invention installed on the roof of a high-rise building. Such a building is particularly prone to being exposed to high velocity winds tending to lift conventional roof ballast blocks. The present invention overcomes the proclivity of conventional blocks to be aerodynamically unstable by providing a unique means for equalizing pressure across the blocks.

Figure 2:
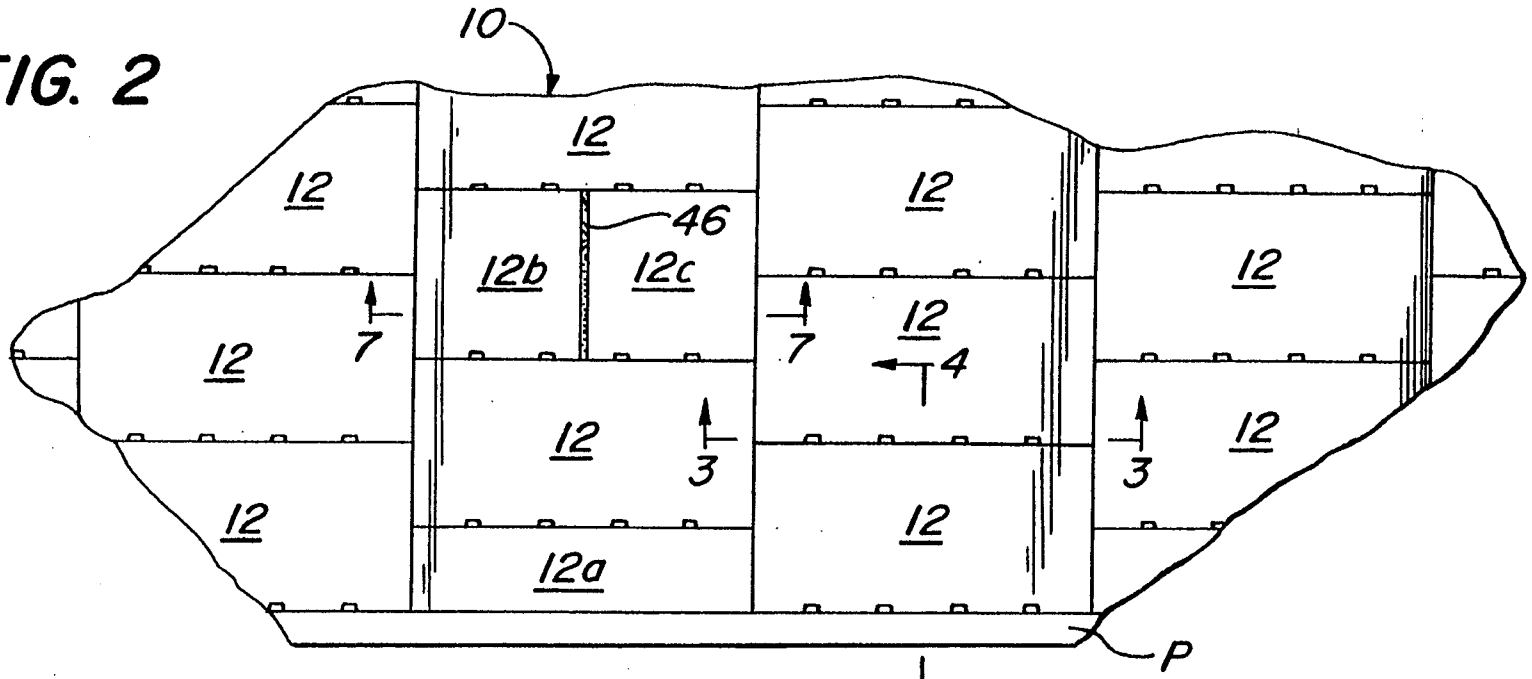
FIG. 2 represents a plan view of ballast blocks in a section of the roof paver system of FIG. 1.

As better illustrated in FIG. 2, the roof ballast system 10 comprises ballast blocks 12 laid in like orientation in contiguous rows with the blocks in each row staggered laterally in side-by-side interlocked relation with blocks in adjacent rows. The ends of rows with insufficient space for a full-size block, such as at roof parapet P, are accommodated by a narrowed block 12*a*. Damaged blocks in an existing installation can be replaced, as shown, with complementary half blocks 12*b* and 12*c*, as will be discussed.

Figure 3:
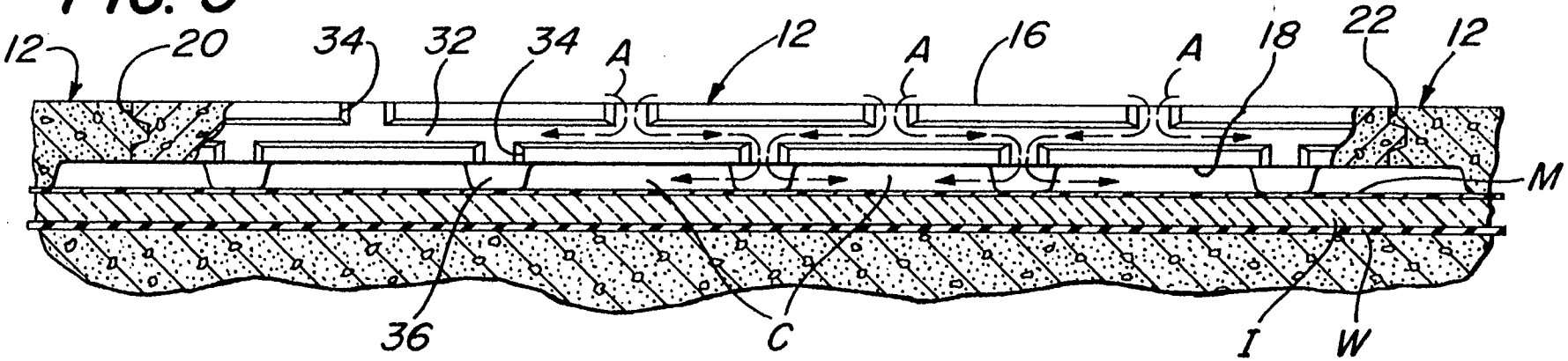
FIG. 3 is an elevation view of the roof paver system taken along the line 3—3 of FIG. 2.
Figure 4:
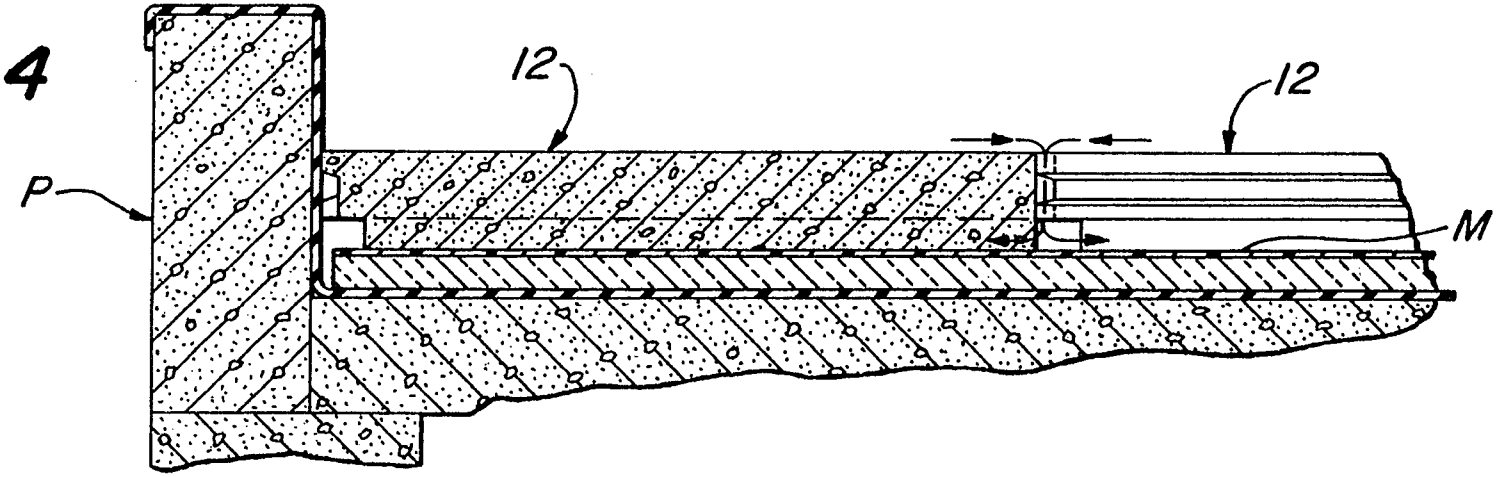
FIG. 4 is an elevation view of the roof paver system taken along the line 4—4 of FIG. 2.

Referring now to FIGS. 3 and 4, blocks 12 in adjacent rows engage in interlocking relation with each other on top of a conventional multi-component roof system which may include a water-impermeable membrane M, such as single-ply PVC sheet, insulation I, and a water-proofing layer W. Other conventional multi-component roofing systems are contemplated for use with the roof ballast system of the invention, depending on design requirements, such as conditions of use, building codes, etc.

Figure 5:
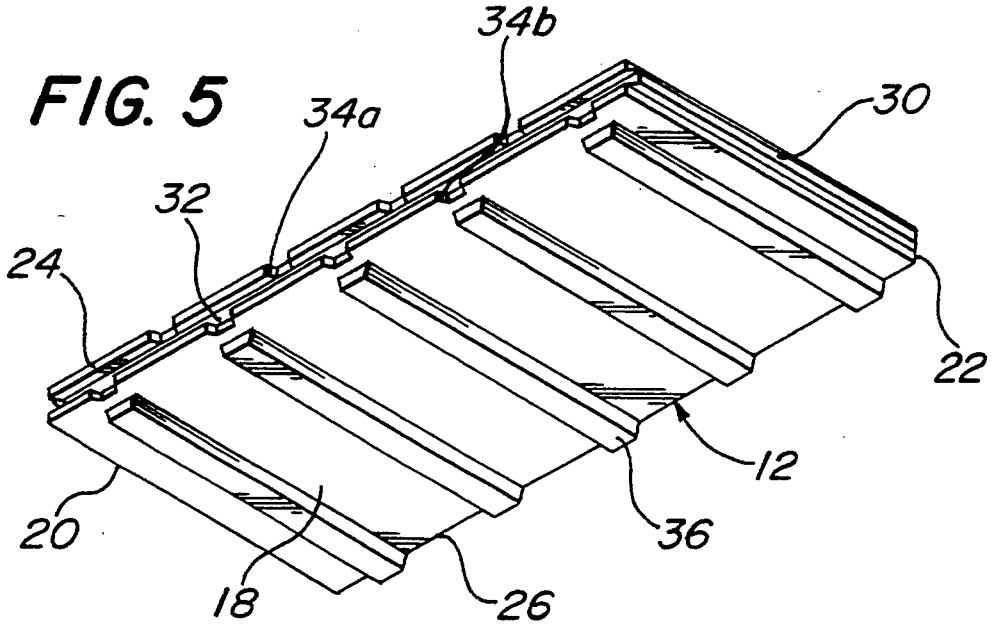
FIG. 5 is an isometric view from below the ballast block of FIG. 2.
Figure 6:
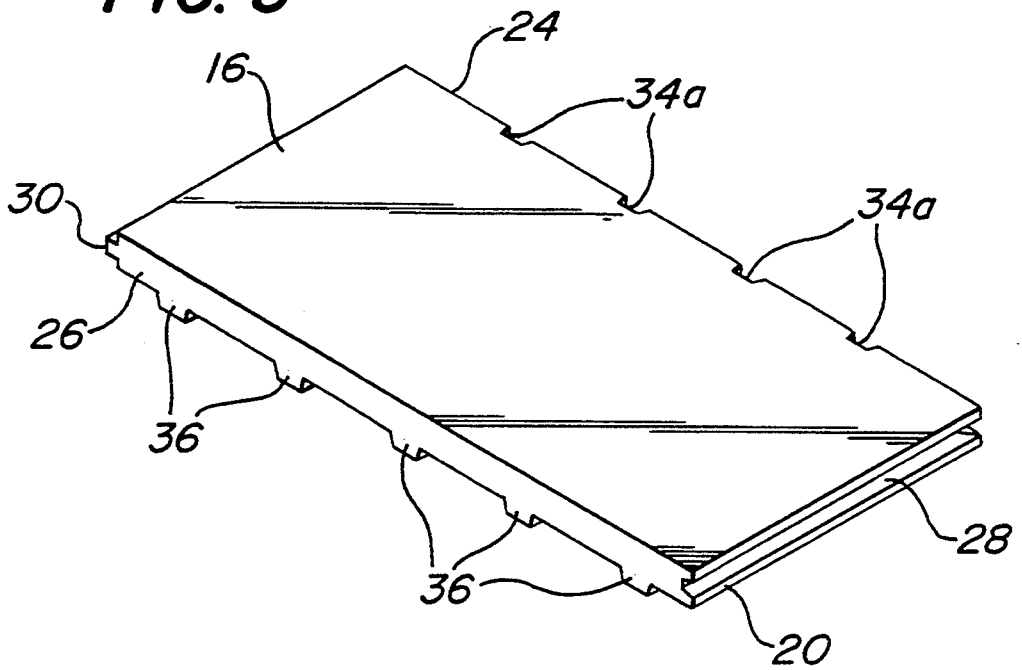
FIG. 6 is an isometric view from above the ballast block of FIG. 5.

Referring also to FIGS. 5 and 6, each ballast block 12 is polygonal in plan, having a generally rectangular configuration in the illustrated embodiment. The block 12 is formed of concrete to have flat top and bottom sides 16 and 18, opposed parallel widthwise edge faces 20 and 22, and opposed parallel lengthwise edge faces 24 and 26. A tapered groove 28 formed along the full length of the widthwise face 20 corresponds in width and depth to a tapered tongue 30 extending along the full length of widthwise face 22. As shown in FIG. 3, blocks 12 in adjacent rows interlock at their complementary tongue and groove edge faces 20 and 22. The staggered relationship of blocks 16 in adjacent rows assures that an edge face 20 or 22 of each block 12 overlaps interlocking edge faces 22 or 20, respectively, of two blocks 12 in the adjacent row. Hence, the laid blocks 12 interact with one another to resist usual lifting forces.

To provide the desired air and water channels, block edge faces 24 and 26 are generally flat in a plane perpendicular to top and bottom sides 16 and 18, with lengthwise-extending face 24 including a groove 32 extending along the full length thereof. Upper and lower recesses 34*a* and 34*b*, respectively, are provided in the block edge face 24 at spaced intervals along its length. The recesses 34*a* and 34*b* extend completely between groove 32 and top and bottom sides 16 and 18, respectively of the block 12. In a plane perpendicular to sides 16 and 18, upper recesses 34*a* are offset from lower recesses 34*b*, preferably by half the distance between adjacent recesses. Thus, with edge faces 24 and 26 of adjacent blocks 12 abutted as shown in FIG. 2, a labyrinthine channel is formed across edge face 24.

In order to space the bottom side 18 of block 12 from the underlying support surface, parallel spaced ribs, or legs, 36 extend from edge face 26 toward edge face 24 a distance slightly less than the distance between edge faces 26 and 24. Ribs 36 thereby provide a series of feet for blocks 12 that form communicating spaces between bottom side 18 of each block and roof membrane M and a chamber C under each block for sub-block drainage. Although the ribs 36 are continuous in the illustrated embodiment, they need not be. Moreover, ribs of other configurations may be utilized provided that the desired spacing and fluid flow functions are maintained.

The course of water drainage and airflow in the channel formed across edge face 24 by the combination of recesses 34*a* and 34*b*, grooves 32, and the chamber C between the undersides of the blocks 12 and membrane M, are best illustrated by the arrows A in FIG. 3. With adjacent blocks 12 supported on membrane M, and the flat edge face 26 of one block 12 abutting grooved edge face 24 of an adjacent block 12, water will drain from the topside of the blocks 12 through to chamber C above membrane M while providing continuous ventilation in the chambers C under the blocks 12 for minimizing any aerodynamically induced pressure differential between the top and bottom sides of the blocks. Thus, when installed in the manner illustrated in FIG. 1, the blocks 12 provide an aerodynamically stable roof paving system.

Figure 7:
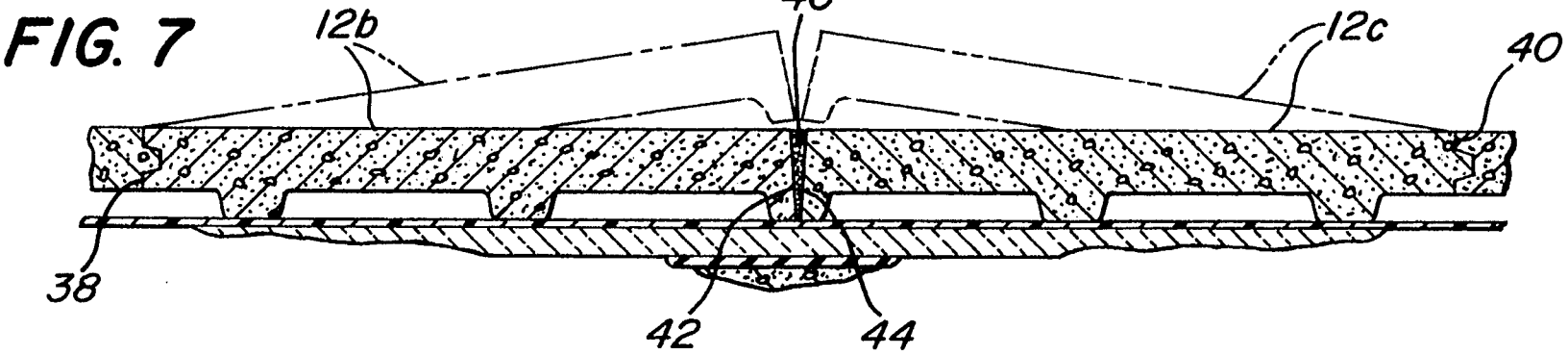
FIG. 7 is an elevation view of the roof paver system taken along the line 7—7 of FIG. 2.

The present invention enables damaged blocks to be replaced readily. To this end, blocks which become damaged after being laid in place can be easily broken out and replaced by sectional replacement blocks 12*a* and 12*b* without losing system integrity. As best seen in FIGS. 2 and 7, each of the replacement block sections 12*b* and 12*c* is dimensioned lengthwise slightly less than half the distance between edge faces 20 and 22 of full block 16. Complementary tongue and groove edge faces 38 and 40 in blocks 12*b* and 12*c*, respectively, interlock respectively with overlapping edge faces 22 and 20 of blocks 12 in adjacent rows. Beveled edge faces 42 and 44, opposite faces 38 and 40, provide mutual clearance during installation of the block sections and provide space across their faces when installed to receive adhesive 46 to insure positive retention. The edge faces need not be beveled to receive adhesive 46 as illustrated, but may be parallel or of some other configuration sufficient to provide installation clearance and to receive adhesive.

By way of example, and not by way of limitation, the block 12 illustrated in FIGS. 5 and 6 is drawn to approximately 6:1 scale. A preferred block 12 is rectangular in plan and has a lengthwise dimension of about 24 inches, a widthwise dimension of about 12 inches, and an overall thickness, excluding ribs, or legs, of about $1\frac{1}{8}$ inches. The ribs have a height of about $\frac{1}{2}$ inch and a footprint of 1 inch. The recesses and channels in the block edges have a depth approximately 5/16 inch, and have widths of $\frac{3}{8}$ to $\frac{5}{8}$ inches. The upper and lower edge recesses are spaced apart on 5 inch centers. Preferably, the edges of the blocks are beveled as illustrated to resist breakage in handling.

The illustrated block 12 is molded of conventional roof ballast block concrete construction. It preferably has a weight in a range of 10 to 25 pounds, and a density of 60 to 150 pounds per cubic foot.

While the preferred block in the illustrated embodiment has the aforementioned specific dimensional and other characteristics, some variations are possible. For instance, if all of the advantages of a labyrinthine channel are not required, the edge recesses may simply extend across the edge of the block from its topside to its bottomside. The plan configuration could be varied from rectangular to square, or perhaps to other geometric configurations, provided the required interlocking edge channels, and sub-block spacing legs are retained to maintain the desired aerodynamic stability.

One contemplated dimensional and structural variation of the block 12 shown in FIGS. 5 and 6 eliminates the two outer lower recesses 34*b* such that the total number of lower recesses 34*b* is reduced to three, and the number of ribs 36 is reduced to four. In this variation of an embodiment of the present invention, the ribs 36 are aligned with the four upper recesses 34*a*. This block variation 12 has a lengthwise dimension of about 18 inches, a widthwise dimension of about 12 inches, and an overall thickness, excluding ribs, or legs, of about 1 3/16 inches. The ribs have a height of about 13/16 inch and a footprint of 1 inch.

Figure 8:
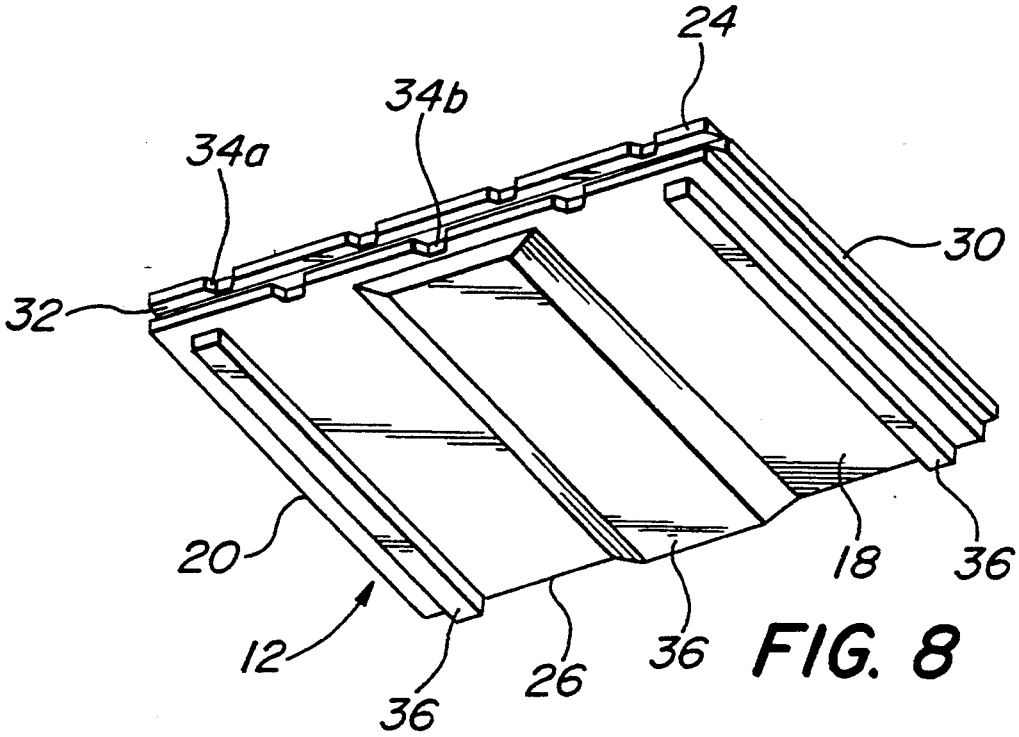
FIG. 8 is an isometric view from below of a modified preferred form of ballast block.
Figure 9:
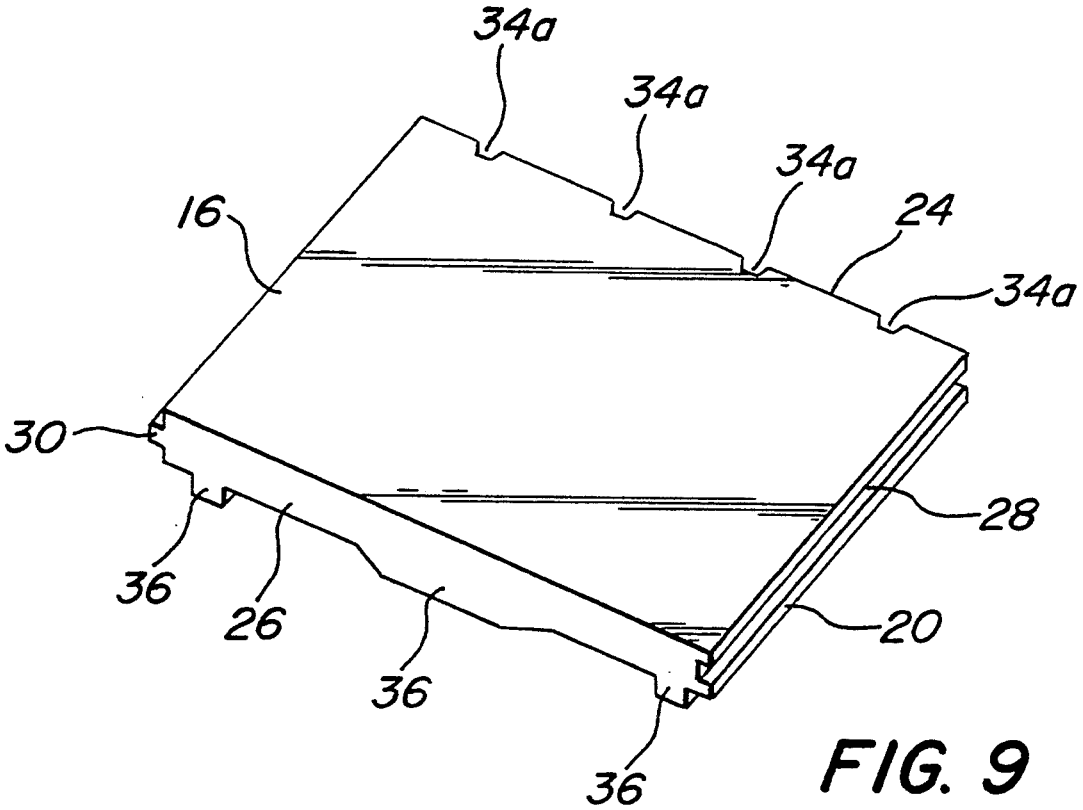
FIG. 9 is an isometric view from above the ballast block of FIG. 8.

Wind-tunnel tests and an analysis of wind effects on scale-model variations of ballast blocks of the present invention have been performed. As a result of these tests, the blocks 12 illustrated in FIGS. 8 and 9, were determined to have the best configuration for resisting wind lift. Thus, the best-mode embodiment is a rectangular block with a length of about 18 inches and a width of about 12 inches. The block 12 has three ribs 36, with the middle rib being wider than the two outer ribs. The middle rib has a footprint of about $3\frac{7}{8}$ inches and the outer ribs have footprints of 1 inch each. The thickness of block 12, excluding the ribs 36, is about 1 3/16 inches. The best-mode embodiment has four upper recesses 34*a* and three lower recesses 34*b*. The edge recesses are otherwise the same, in size, as in the preceding embodiments.

From the tests, it was determined that rib heights on the ballast blocks significantly affect performance of the ballast block system to resist wind lift. Therefore, in the best-mode embodiment, the ribs 36 have heights of about $\frac{3}{8}$ inch. The height may also be applied to the rib heights of the preceding embodiments as well. This approximate height allows sufficient drainage of water while providing sufficient equalization of air pressure across the top and bottom sides of the ballast block system to provide the desired aerodynamic stability.

Some of the many advantages of the invention should now be readily apparent. For instance, the ballast blocks cooperate with one another to provide an aerodynamically-stable roof system particularly suited for use in unusual wind conditions. This is accomplished by arranging ballast blocks in a row such that they interlock with ballast blocks in adjacent rows while air and water flow between the block edges to accommodate any sudden reduction in the air pressure above the blocks that would have a tendency to displace the blocks. Each block has at least one edge with a channel providing labyrinthine path providing for air and water movement between the topsides and bottomsides of adjacent blocks while preventing direct exposure of underlying roofing materials to the elements at the block edges. The ballast blocks afford a unique roof construction which substantially reduces the effect of aerodynamic lift induced by high wind conditions across the blocks. The blocks are lightweight, inexpensive to manufacture, and relatively easy to install or replace if they become damaged.

It will be understood, of course, that various changes in the details, materials, steps and arrangement of parts, which have been herein described and illustrated in order to explain the nature of the invention may be made by those skilled in the art within the spirit and scope of the invention as expressed in the appended claims.

I claim:

1. An aerodynamically-stable roof ballast system for protecting a membrane-type roof, said system comprising a plurality of blocks superposed on said roof in laterally interlocked relation, each of said blocks having a topside and a bottomside with leg means for spacing said bottomside from said roof to define a chamber therebetween, each block having selected edge faces with complementary means for interlocking with adjacent blocks, each block also having channel means providing fluid communication between said block topside and said chamber for enabling any aerodynamically-induced pressure differential across said interlocked blocks to be equalized while permitting fluid to drain through said interlocked blocks to said chamber above said roof, whereby the ballast system is aerodynamically stable in unusual wind conditions.

2. An aerodynamically-stable roof ballast system according to claim 1 wherein said channel means is provided at selected locations between laterally abutting blocks.

3. An aerodynamically-stable roof according to claim 2 wherein said channel means includes means forming a plurality of labyrinthine channels disposed between adjacent blocks at said selected locations.

4. An aerodynamically-stable roof according to claim 2 wherein said selected edge faces are located at opposite ends of each said block, each of said blocks has other edge faces which are adjacent to said selected edge faces, and said channel means is provided in at least one of said other edge faces.

5. An aerodynamically-stable roof according to claim 4 wherein said channel means is provided by a continuous groove in said at least one other edge face and at least one recess extending between said topside and said groove and at least one other recess extending between said bottomside and said groove.

6. An aerodynamically-stable roof according to claim 5 wherein said one recess is offset along said groove from said other recess to form thereby a labyrinthine channel between the topside and bottomside of each said block at said at least one other edge face.

7. An aerodynamically-stable roof according to claim 2 wherein said complementary interlocking means includes a tongue extending along one edge of each said block and a groove extending along another edge of each said block opposite said tongue.

8. An aerodynamically-stable roof according to claim 7 wherein said blocks are laid in rows in staggered relation with the tongue of one block engaged in the grooves of a laterally abutted adjacent pair of blocks.

9. An aerodynamically-stable roof according to claim 8 wherein said channel means is provided in another block edge extending between said tongue and said groove.

10. For assembly with like blocks to form an aerodynamically-stable roof ballast system, a ballast block having a topside and a bottomside with leg means for supporting said bottomside above an underlying roof structure, said block having peripheral edges extending between said topside and said bottomside, at least a selected one of said peripheral edges having formed therein at least one channel providing fluid communication between said topside and said bottomside of said block at said selected edge, selected other peripheral edges of said block having complementary matingly-engageable means adapted to interlock laterally with an adjacent block of like construction, whereby when the blocks are laid upon a roof in laterally interlocked abutting relation, the channel in the block edge accommodates aerodynamically induced forces tending to lift the blocks by equalizing air pressure on opposite sides of the block.

11. A ballast block according to claim 10 wherein said channel extends along said selected one edge between said topside and said bottomside and said selected one edge has an upper recess connecting said channel with the topside of the block and a lower recess connecting the channel with the bottomside of the block.

12. A ballast block according to claim 11 wherein said upper recess is offset from said lower recess.

13. A ballast block according to claim 12 wherein there are a plurality of said upper and lower recesses in said block.

14. A ballast block according to claim 13 wherein said block has a edge located opposite said selected one edge and complementary therewith so that when said selected one edge of one block is abutted laterally against said complementary edge of an adjacent block, the edges cooperate to define a labyrinthine flow path for air and fluid.

15. A ballast block according to claim 10 wherein said block is rectangular in plan with said selected other matingly engageable peripheral edges extending widthwise of the block and said channel extending lengthwise of the block.

16. A ballast block according to claim 15 wherein said leg means includes a plurality ribs extending in spaced parallel relation for less than the entire width of the block.

17. A ballast block according to claim 16 wherein said plurality of ribs includes a relatively wide central rib and at least one rib on opposite sides thereof.

18. A ballast block according to claim 10 wherein said matingly engageable means includes a tongue extending along one of said block peripheral edges and a groove extending along an opposite one of said block peripheral edges.

19. A roof ballast block for assembly with like blocks to form an aerodynamically-stable pavement overlying a roof structure, said ballast block having a rectangular plan configuration with a topside, a bottomside and peripheral edge faces, means depending from said bottomside for supporting it in spaced relation above said roof structure and permitting air and fluid to flow therebelow, an opposed widthwise pair of said edge faces, one having a tongue and the other having a groove for matingly engaging in a complementary tongue and groove in at least one adjacent block, a selected other one of said edge faces having a lengthwise extending groove and a series of upper and lower recesses extending in spaced relation between the topside of the block and said lengthwise extending groove and between the bottomside of the block and said lengthwise extending groove, the upper recesses being offset horizontally from the lower recesses for cooperating with the groove the define a labyrinthine channel across the edge face for conducting air and water across the block, whereby assembly of the block in interlocking relation with like blocks on a roof structure provides a roof paver system which is aerodynamically stable in unusual wind conditions.

* * * * *